US008834011B2

(12) United States Patent
Dietrich et al.

(10) Patent No.: US 8,834,011 B2
(45) Date of Patent: Sep. 16, 2014

(54) DEVICE FOR PNEUMATIC TREATMENT OF POWDER MATERIALS

(75) Inventors: Frédéric Dietrich, Morrens (CH); Yves Dietrich, Chevilly (CH)

(73) Assignee: Dietrich Engineering Consultants S.A., Ecublens/Lausanne (CH)

( * ) Notice: Subject to any disclaimer, the term of this patent is extended or adjusted under 35 U.S.C. 154(b) by 1151 days.

(21) Appl. No.: 10/592,900

(22) PCT Filed: Mar. 11, 2005

(86) PCT No.: PCT/EP2005/002643

§ 371 (c)(1),
(2), (4) Date: Jan. 25, 2007

(87) PCT Pub. No.: WO2005/092485

PCT Pub. Date: Oct. 6, 2005

(65) Prior Publication Data

US 2008/0037364 A1 Feb. 14, 2008

(30) Foreign Application Priority Data

Mar. 15, 2004 (DE) ..... 10 2004 012 772
May 3, 2004 (DE) ..... 10 2004 021 612

(51) Int. Cl.
*B01F 3/18* (2006.01)
*B01F 5/10* (2006.01)

(52) U.S. Cl.
USPC ..... 366/139; 366/165.1

(58) Field of Classification Search
USPC ..... 222/195; 366/25, 101, 107, 173.2, 139, 366/165.1–165.5
See application file for complete search history.

(56) References Cited

U.S. PATENT DOCUMENTS

| | | | | | |
|---|---|---|---|---|---|
| 981,098 | A | * | 1/1911 | McCaskell | 422/224 |
| 1,471,690 | A | * | 10/1923 | Fish et al. | 222/195 |
| 1,576,911 | A | * | 3/1926 | Hughes | 366/165.3 |
| 1,580,476 | A | * | 4/1926 | Fassio | 68/184 |
| 1,601,727 | A | * | 10/1926 | Faragher et al. | 366/107 |
| 1,736,065 | A | * | 11/1929 | Williams | 423/653 |
| 1,802,475 | A | * | 4/1931 | Lucke | 122/5 |
| 1,839,456 | A | * | 1/1932 | Evald | 366/107 |
| 1,867,739 | A | * | 7/1932 | Frazee | 366/18 |

(Continued)

FOREIGN PATENT DOCUMENTS

| | | |
|---|---|---|
| CH | 670 399 | 6/1989 |
| EP | 0 538 711 | 4/1993 |

(Continued)

OTHER PUBLICATIONS

Official action for CN 200580008261.7, Aug. 12, 2010.

(Continued)

*Primary Examiner* — Charles Cooley
(74) *Attorney, Agent, or Firm* — Bachman & LaPointe, P.C.

(57) ABSTRACT

A device for pneumatic treatment of powder materials in a recipient chamber (22), with introduction of two material streams into the above through two inlet tubes (40, 40$_a$), optionally in a counter-current and/or approximately tangential sense and swirled in the recipient chamber (22). The material streams are for introduction at roughly the same level in the container and the tracks thereof are interleaved. The material streams are also introduced at an inclination angle (w) to a radial plane (E) of the recipient chamber (22) which is inclined downwards.

12 Claims, 3 Drawing Sheets

(56) References Cited

U.S. PATENT DOCUMENTS

| | | | | | |
|---|---|---|---|---|---|
| 1,961,548 | A | * | 6/1934 | Caise | 68/184 |
| 1,984,315 | A | * | 12/1934 | Morris | 432/110 |
| 2,025,404 | A | * | 12/1935 | Stahn | 366/107 |
| 2,125,913 | A | * | 8/1938 | Goebels | 366/137 |
| 2,193,005 | A | * | 3/1940 | Ish-Shalom | 366/107 |
| 2,277,361 | A | * | 3/1942 | Bonotto | 34/498 |
| 2,305,938 | A | * | 12/1942 | Turnbull | 366/25 |
| 2,331,208 | A | * | 10/1943 | Ludi | 73/302 |
| 2,368,638 | A | * | 2/1945 | Bryce et al. | 137/1 |
| 2,421,345 | A | * | 5/1947 | McConnaughay | 366/25 |
| 2,435,884 | A | * | 2/1948 | Galewski | 366/136 |
| 2,528,514 | A | * | 11/1950 | Harvey et al. | 71/41 |
| 2,529,530 | A | * | 11/1950 | Abildgaard et al. | 119/669 |
| 2,544,616 | A | * | 3/1951 | Sartorius | 34/372 |
| 2,548,332 | A | * | 4/1951 | Cruzan et al. | 336/107 |
| 2,564,745 | A | * | 8/1951 | Wintermyer | 366/107 |
| 2,586,818 | A | * | 2/1952 | Harms | 209/474 |
| 2,687,213 | A | * | 8/1954 | MacLeod | 209/164 |
| 2,714,043 | A | * | 7/1955 | Glaza | 406/137 |
| 2,750,681 | A | * | 6/1956 | Barthelemy | 34/579 |
| 2,751,425 | A | * | 6/1956 | Rupp | 585/716 |
| 3,035,739 | A | * | 5/1962 | Berg | 222/135 |
| 3,047,275 | A | * | 7/1962 | Cox | 366/101 |
| 3,097,828 | A | * | 7/1963 | Grun | 366/106 |
| 3,106,385 | A | * | 10/1963 | Arthur et al. | 366/134 |
| 3,306,587 | A | * | 2/1967 | Schroedter | 366/162.4 |
| 3,391,908 | A | * | 7/1968 | MacDonald | 366/101 |
| 3,425,669 | A | * | 2/1969 | Gaddis | 366/153.1 |
| 3,448,965 | A | * | 6/1969 | Young | 366/134 |
| 3,568,733 | A | * | 3/1971 | Lau | 141/10 |
| 3,627,555 | A | * | 12/1971 | Driscoll | 106/472 |
| 3,713,564 | A | * | 1/1973 | Cottrell | 222/1 |
| 3,832,201 | A | * | 8/1974 | Shearer | 106/281.1 |
| 3,840,215 | A | * | 10/1974 | McConnaughay | 366/25 |
| 3,846,079 | A | * | 11/1974 | Alagy et al. | 422/234 |
| 3,879,021 | A | * | 4/1975 | Riley | 366/137.1 |
| 3,999,750 | A | * | 12/1976 | Perkins | 472/65 |
| 4,002,325 | A | * | 1/1977 | Herfeld | 366/101 |
| RE29,496 | E | * | 12/1977 | Dydzyk | 366/25 |
| 4,136,964 | A | * | 1/1979 | Swisher, Jr. | 366/23 |
| 4,187,029 | A | * | 2/1980 | Canale et al. | 366/153.1 |
| 4,239,421 | A | * | 12/1980 | Krauss | 406/12 |
| 4,398,827 | A | * | 8/1983 | Dietrich | 366/107 |
| 4,430,003 | A | * | 2/1984 | Beattie et al. | 366/137.1 |
| 4,480,925 | A | * | 11/1984 | Dietrich | 366/107 |
| 4,491,414 | A | * | 1/1985 | Hayatdavoudi et al. | 366/6 |
| 4,491,419 | A | * | 1/1985 | Ahrens et al. | 366/101 |
| 4,496,076 | A | * | 1/1985 | Tompkins | 222/3 |
| 4,498,819 | A | * | 2/1985 | El-Saie | 406/181 |
| 4,643,582 | A | * | 2/1987 | Ricciardi | 366/102 |
| 4,647,212 | A | * | 3/1987 | Hankison | 366/165.5 |
| 4,812,045 | A | * | 3/1989 | Rivers | 366/107 |
| 4,863,277 | A | * | 9/1989 | Neal et al. | 366/137 |
| 4,934,569 | A | * | 6/1990 | Womack | 222/195 |
| 4,955,723 | A | * | 9/1990 | Schneider | 366/136 |
| 4,957,434 | A | * | 9/1990 | Radomsky | 432/103 |
| 5,009,508 | A | * | 4/1991 | Wojdylo | 366/10 |
| 5,050,995 | A | * | 9/1991 | Lucore, II | 366/136 |
| 5,073,030 | A | * | 12/1991 | Banks | 366/25 |
| 5,090,813 | A | * | 2/1992 | McFarland et al. | 366/23 |
| 5,253,937 | A | * | 10/1993 | Scheimann et al. | 366/136 |
| 5,378,060 | A | * | 1/1995 | Brock et al. | 366/25 |
| 5,518,700 | A | * | 5/1996 | Ayoub et al. | 422/225 |
| 5,603,566 | A | * | 2/1997 | O'Ryan et al. | 366/107 |
| 6,071,005 | A | * | 6/2000 | Ekambaram et al. | 366/173.2 |
| 6,325,572 | B1 | | 12/2001 | Dietrich | |
| 6,357,906 | B1 | * | 3/2002 | Baudoin et al. | 366/163.2 |
| 6,854,878 | B2 | | 2/2005 | Jacob | |
| 7,018,435 | B1 | * | 3/2006 | Wentinck | 48/198.8 |
| 7,025,492 | B2 | * | 4/2006 | Dorsch et al. | 366/165.1 |
| 7,575,364 | B2 | * | 8/2009 | Goto et al. | 366/165.2 |
| 7,731,411 | B2 | * | 6/2010 | Pessin et al. | 366/107 |
| 7,866,881 | B2 | * | 1/2011 | El Kholy et al. | 366/348 |
| 2003/0170156 | A1 | * | 9/2003 | Kemp et al. | 422/224 |
| 2006/0164914 | A1 | * | 7/2006 | Goto et al. | 366/165.2 |
| 2007/0253279 | A1 | * | 11/2007 | Schumacher et al. | 366/101 |
| 2008/0037364 | A1 | * | 2/2008 | Dietrich et al. | 366/148 |
| 2008/0062812 | A1 | * | 3/2008 | Braden | 366/134 |
| 2008/0094934 | A1 | * | 4/2008 | Chiang et al. | 366/102 |

FOREIGN PATENT DOCUMENTS

| | | | | |
|---|---|---|---|---|
| EP | 0 574 596 | | 12/1993 | |
| EP | 1 304 304 | | 4/2003 | |
| FR | 1378555 | | 10/1964 | |
| GB | 1055533 | | 1/1967 | |
| JP | 55-88834 | | 7/1980 | |
| JP | 56102930 | A * | 8/1981 | B01F 5/00 |
| WO | 01/87474 | | 11/2001 | |

OTHER PUBLICATIONS

Official action for IN 3347/CHENP2006, dated Aug. 10, 2011.

* cited by examiner

DEVICE FOR PNEUMATIC TREATMENT OF POWDER MATERIALS

BACKGROUND OF THE INVENTION

The invention relates to a method and to a device for pneumatic treatment of powder materials with a container connected to a feed line and a discharge for the material being conveyed.

EP 0 538 711 A reveals a conveying device, for example for plastic granules, with a hose line which, at one end, enters a storage silo by means of a lance and, at the other end, projects through a filter cartridge into a connecting branch which sits on the box-like inflow of a tangential feed opening of a plasticizing cylinder. A cover subassembly, through which the hose line likewise passes, is provided with a suction chamber via the filter cartridge. Said suction chamber has suction openings directed toward the connecting branch and is operatively connected to a nozzle system, to which compressed air or compressed gas can be supplied as the working medium. A relatively high negative pressure is generated in the suction chamber and propagates through the suction openings and the filter into the connecting branch and from there through the suction line into the storage silo. The working medium is intended to generate such a high pressure, by means of an increase in its speed, in the material being conveyed that the solid materials are sucked, by mixing with a suction air stream, to said box-like inflow. At the filters, the solid materials are separated from the suction air stream and the latter is mixed with the working medium. Cleaning of the filter can not be carried out during the process.

EP 0 574 596 A describes a system for the pneumatic transfer of cement from ships into silos by means of a "sluice-type container" comprising a plurality of container segments; an exhaust air filter sits in the uppermost container segment and the lowermost container segment tapers in the manner of a funnel.

Powder materials are also conveyed and transported in a controlled atmosphere in the chemical, pharmaceutical and foodstuffs industry. The known systems for conveying powder materials of this type are generally coordinated in terms of construction to the product to be subsequently conveyed; these systems are individual manufacturing systems causing high system costs.

The pouring of powder into reaction vessels or reactors within explosive zones takes place in general manually via a sluice or a protective valve, since most reactors do not have the necessary space for an adequate loading system. Such a manner of operation does not comply with the existing safety rules for preventing the risk of explosion; if the reactor is inerted, the manual pouring in of powders from the manhole leads to atmospheric pressures and neutralizes the protective effect of the inert gas. If solid materials are entered manually, the inerting is neutralized within a short time ($O_2$ concentration>8%) and is not produced again even after relatively prolonged $N_2$ flushing during operation.

In recognition of these circumstances, the inventor has set himself the aim of permitting cost-effective mixing and conditioning of powder materials.

The object is achieved by the present invention as described below.

SUMMARY OF THE INVENTION

According to the invention, two material streams are supplied—in particular in opposite directions—to the container chamber through at least two supply tubes and are swirled in the container chamber. For this purpose, it has proven expedient for the material streams to be supplied approximately tangentially, preferably, in addition, at approximately the same container height, so that their tracks are interleaved. Intimate swirling is thereby produced.

For this purpose, the material streams are preferably also conducted in at an angle of inclination to a radial plane of the container, i.e. the material streams are introduced in a downwardly directed manner.

According to one of the possibilities for carrying out the method according to the invention, each of the material streams is removed from a common vessel and a circular movement thus produced. For this purpose, the swirled material streams are to be introduced from the container chamber into the common vessel and are to be removed therefrom together.

Another procedure—which can also be combined with the above method—is also to remove each of the material streams from a separate vessel. In the last-mentioned case, preferably different materials are mixed with one another.

A further favorable procedure lies within the scope of the invention, in which the material stream is conducted through at least two hollow profiles connected axially one behind the other and, in the latter, is guided past temperature-generating devices. In this case, according to the invention, the material stream is heated and dried in the outlet region of the hollow profile.

A device lies within the context of the invention, which device is to be used above all when carrying out the above methods and in which at least two supply lines are provided for a respective material stream and said supply lines are connected to a respective connecting branch; according to one feature of the invention, these connecting branches open in the same direction into the container interior, so that the material streams leaving them encounter one another and thus carry out the swirling.

It has proven favorable to provide at least two connecting branches which are approximately parallel to each other on the container and for them to preferably be assigned to a common radial plane; in an advantageous manner, they are to enclose an angle of inclination with the radial plane toward the container axis and/or are to be inclined downward toward the container interior. It has also proven favorable for the connecting branches to open somewhat offset in height with respect to each other into the container interior.

The container preferably sits with its lower end on a collecting vessel and is provided at the other end with a connecting branch.

It is preferred to join the vessel interior of the collecting vessel in the topward direction to at least one bottom aperture of the container and to provide it with a bottomward outflow element. At least one reflection device can be arranged in the flow path in the vessel interior as an impact element, against which the particles impact and are pushed back into the stream.

According to the invention, the bottomward outflow element has at least two output elements for a respective line—connected at the other end to one of the attachment branches; said line is intended, according to a further feature of the invention, to connect the outflow element of the reaction vessel to an attachment branch of the container, i.e. to connect a circular movement.

In a further refinement, a branch line is connected to the line; this branch line is then connected at the other end to a vessel which contains one of the powder materials.

Another device according to the invention serves to change the temperature of the material being conveyed, in the case of which device at least one temperature-generating device, preferably a hot-air-generating device, crossing the conveying track of the material being conveyed, is arranged in the interior of the container. In this case, at least two tubular hollow profiles of uniform cross section are advantageously to be joined axially to each other by an intermediate chamber, and the hot-air-generating device is to be arranged in the intermediate chamber; said hot-air-generating device is preferably inclined with respect to the longitudinal axis of the device.

It has proven favorable to allow the lower hollow profile to end at a bottom chamber which is connected to the upper hollow profile by a conveying line in order to permit circulation.

The object as seen by the inventor is achieved in a brilliant manner by the invention; the system according to the invention provides:

a closed, self-filling mixing system with a high degree of containment;

very efficient mixing, i.e. significantly lower mixing times in comparison to conventional systems;

the possibility of mixing different powders in very different ratios (1/10 000);

operation with the exclusion of an oxygen atmosphere and with little consumption of nitrogen;

complete emptying of the system with the possibility of cleaning in situ;

the direct addition of relatively small amounts of product to the mixture without interrupting the process;

the possibility of allowing powder properties to be changed during the mixing operation;

the design of fixed systems with which powder can be sucked up from various containers (barrels, big-bags, silos, etc.)

the sucking up of powder over considerable distances;

the use of extremely operationally reliable and only few movable parts with low maintenance.

BRIEF DESCRIPTION OF THE DRAWINGS

Further advantages, features and details of the invention emerge from the following description of preferred exemplary embodiment and with reference to the drawing; in the latter.

DETAILED DESCRIPTION

Figure 1:
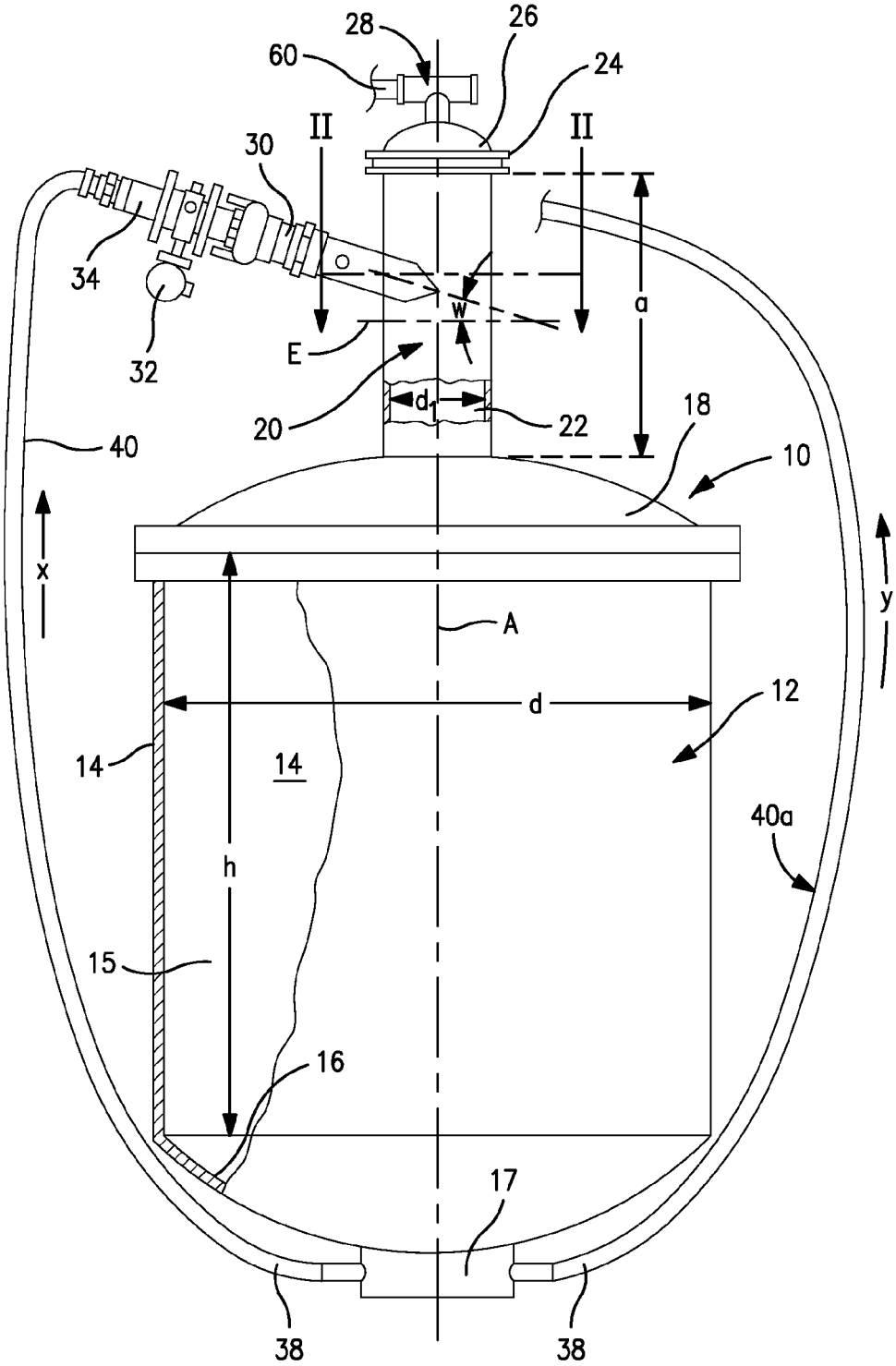
FIG. 1 shows a device according to the invention in a partially cutaway side view.

A device 10 for pneumatic conveying of powder materials of a small range of grain sizes has a collecting vessel 12 as main container with a cylindrical vessel wall 14 of height h and outer diameter d. The interior 15 of the collecting vessel 12 is closed downward by a housing bottom 16 from which a bowl-like bottom branch 17 protrudes along the vessel axis A.

The vessel interior 15 is covered by a dome-type cover 18 from which—axially with respect to the vehicle axis A—a cylindrical container 20 of electrolytically polished stainless steel of length a of, for example, 600 mm rises up; the interior 22 thereof of diameter $d_1$ of, here, 200 mm serves as the swirling chamber. This container interior 22 is covered by a plate-like sieve 24 above which a—here T-shaped—connecting branch 28 rises from a container cover 26. A vacuum line 60 can be connected to said connecting branch at one end and a conveying gas line can be connected thereto at the other end, with at least the latter containing a shut-off valve. Valves of this type are indicated by way of example at 29 in FIG. 3.

Figure 2:
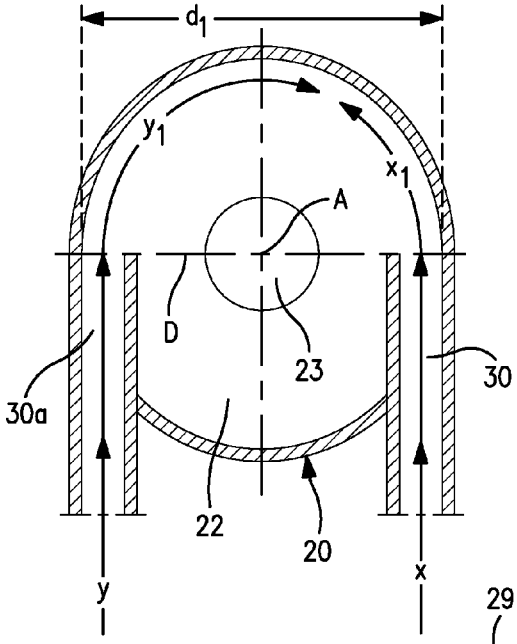
FIG. 2 shows the enlarged cross section through FIG. 1 along its line II-II.

Two lateral attachment branches 30, $\mathbf{30}_a$ which run in an inclined manner—according to FIG. 2 parallel to each other at both ends of a common diametric—downward toward the vessel axis A—at an angle w of, here, approximately 15° to a radial plane E—lead into the container interior 22. A respective butterfly valve 32 is integrated as shut-off element in a connecting flange 34 in these attachment branches 30, $\mathbf{30}_a$.

From each of the supply tubes or attachment branches 30, $\mathbf{30}_a$, a hose-like line 40 or $\mathbf{40}_a$ leads to a respective radial tube 38 of said bowl-like bottom branch 17. Furthermore, for the sake of better clarity, only part of the line $\mathbf{40}_a$ situated on the right in FIGS. 1, 3 is illustrated.

Two streams of powder materials are conducted tangentially in the conveying direction x or y through the attachment branches 30, $\mathbf{30}_a$ and the lines 40, $\mathbf{40}_a$ to the interior 22 of the container 20 and, according to FIG. 2, are transferred on the inner surface of the container 20 into circular tracks $x_1$ and $y_1$ running in opposite directions. A swirling of the materials and the intimate mixing thereof are therefore produced. This mixture enters the vessel interior 15 owing to a central bottom aperture 23—of closable design.

Figure 3:
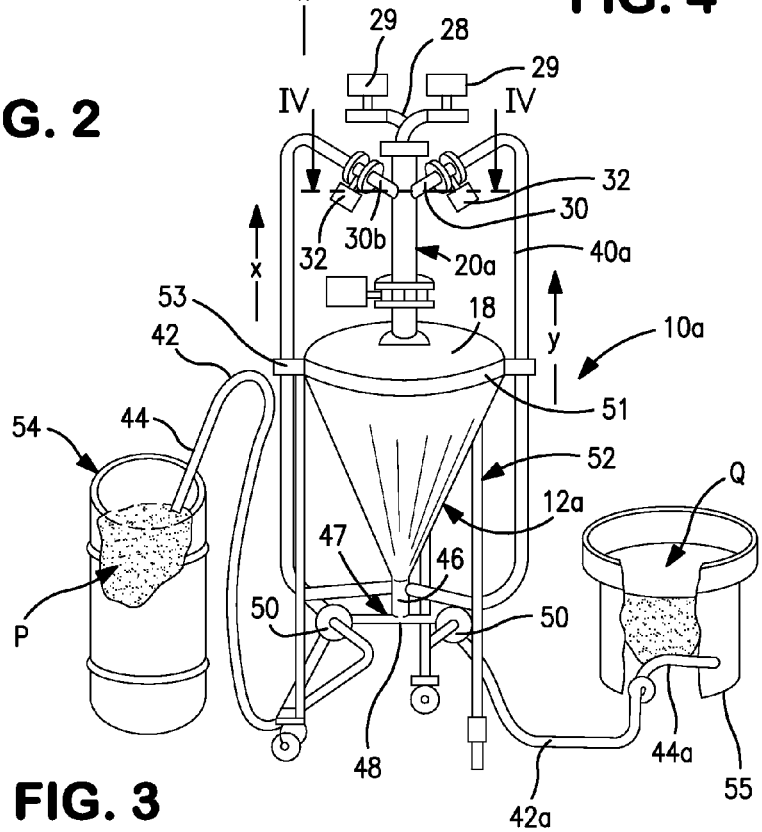
FIG. 3 shows a further embodiment in a partially cutaway oblique view.

In the exemplary embodiment $\mathbf{10}_a$ according to FIG. 3, the collecting vessel $\mathbf{12}_a$—which is suspended in a supporting ring 51 of an undercarriage 52—is of funnel-like design, and its tip 46 merges into an T-shaped tube connection 47, to the cross tube 48 of which the two lines 40, $\mathbf{40}_a$ are connected. Said lines are secured in holding loops 53 of said supporting ring 51. A respective intermediate piece is integrated here into each of the lines 40, $\mathbf{40}_a$ as a sluice-type insert 50 to which a branch line 42 or $\mathbf{42}_a$ is connected; said branch line ends at the other end with an insert tip 44 or $\mathbf{44}_a$ of rigid material.

Figure 4:
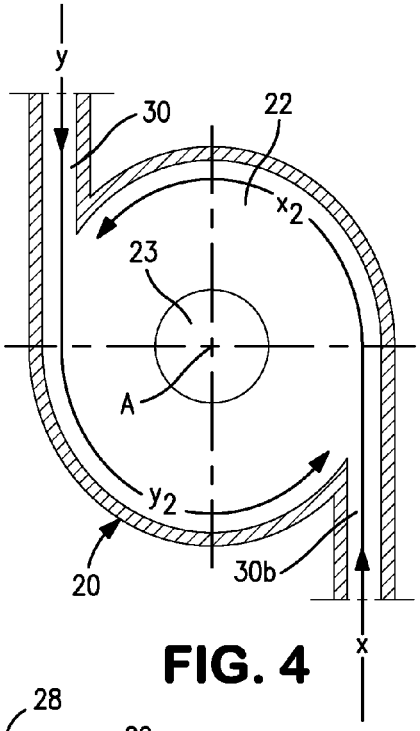
FIG. 4 shows an enlarged cross section, corresponding to the position of line II-II in FIG. 1, through FIG. 3.

The insert points 44 and $\mathbf{44}_a$ of the branch lines 42 and $\mathbf{42}_a$ are respectively submerged into vessels 54, 55 which contain different powders P, Q; the latter are supplied through the lines 40/42 and $\mathbf{40}_a$/$\mathbf{42}_a$ to the swirling operation in the container interior 22. In this configuration—as can be seen above all in FIG. 4—the parallel attachment branches 30, $\mathbf{30}_b$ are arranged in opposite directions, so that the circular tracks $x_2$, $y_2$ of the material streams x, y are directed in the same direction. The swirling arises here by the circular tracks $x_2$, $y_2$ encountering each other laterally.

By means of a switching-over operation into the intermediate pieces 50 of the lines 40, $\mathbf{40}_a$, the latter are temporarily separated from their branch lines 42, $\mathbf{42}_a$, and a circular movement arises between the vessel interior 15 and the interior 22 of the container 20 to provide further swirling.

Other possible configurations, the containers 20 of which provide more than one pair of attachment branches 30, $\mathbf{30}_a$ for the connection to more than two lines 40, $\mathbf{40}_a$ are not illustrated.

With the devices 10, $\mathbf{10}_a$ described, entirely different powders can be effortlessly mixed in a completely closed manner. In the pharmaceutical sphere, this technology is suitable particularly for the contamination-free handling of active substances, the properties of which must not be changed.

The system comprises—as described—a main container 12, $\mathbf{12}_a$ with a deflector installed in its center. A conveying system with two tangential attachment branches 30, $\mathbf{30}_a$ as inputs is fitted above the main container 12, $\mathbf{12}_a$. During a suction phase, the butterfly valves 32 of said attachment branches open.

The powders are introduced automatically by a powder-conveying system and are guided in a circulating manner through the main container 12, $\mathbf{12}_a$ for a previously precisely determined period of time. In this case, a reflection device ensures a homogeneous distribution of the powder mixture in the main container 12, $\mathbf{12}_a$.

When the two powder jets meet, the mixing effect permits a considerable increase in the speed and efficiency of the mixing. The restricted speed of circulation prevents damage to the particles.

The system can be operated without any problem with oxygen being excluded. This permits even hygroscopic powders, such as powders which can oxidize or explode, to be mixed.

This technology can easily be integrated into a pharmaceutical production line. Powders can automatically be sucked up out of the vessels 54, 55—for example out of barrels, sacks—or directly from process apparatuses, granulators or the like. After the mixing operation is ended, the system can be emptied fully automatically and completely in the next processing step. This system does not contain any movable or rotating mechanical parts, which permits easy automatic cleaning.

Figure 5:
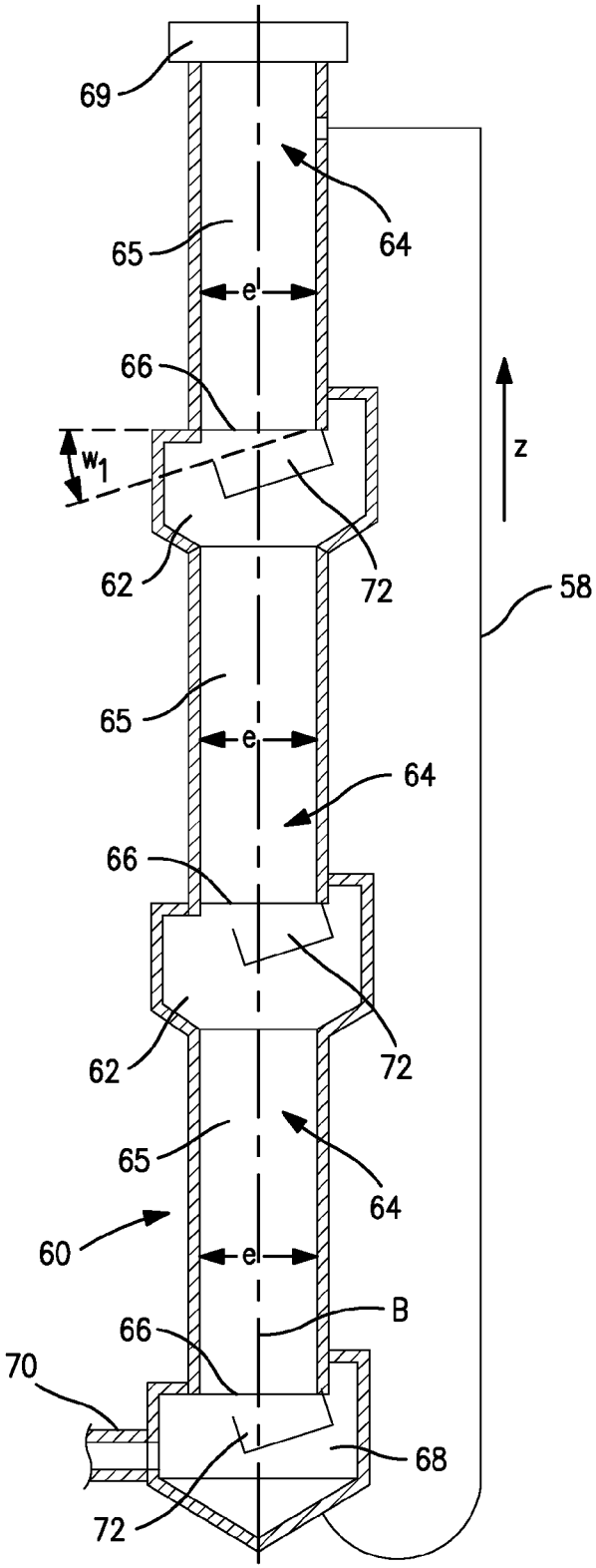
FIG. 5 shows another device according to the invention in a schematized, cutaway front view.

FIG. 5 shows a mixing tower 60 with three cylindrical tubes or similar hollow profiles 64 of inner diameter e—which are connected by intermediate chambers 62 and are assigned to a common longitudinal axis B—the lower of which is downwardly closed by a bottom chamber 68 and the topward one of which is upwardly closed by a cover 69. The diameter f of the chambers 62, 68 is larger than that of the hollow profiles or cylindrical tubes 64. A connecting branch for a supply or removal line is indicated at 70.

The lower mouths 66 of the cylindrical tubes 64 are assigned hot-air generators 72—which are inclined downward at an angle $w_1$ of approximately 15°—which ensure that the material circulating through the tube chambers 65 of the mixing tower 60 and an outer line 58 in the conveying direction z dries.

The invention claimed is:

1. A device for pneumatic treatment of different powder materials (P, Q) comprising a container having at least two supply lines for supplying different powder materials to the container and a discharge, the at least two supply lines are connected by respective connecting branches to the container, the container has a lower end which sits on a collecting vessel, the collecting vessel has a vessel interior for receiving a mixture of the different powder materials from the discharge, the vessel interior has a bottom which is provided with a bottomward outflow element, the bottomward outflow element has at least two output elements each connected to one of the at least two supply lines connected at the other end to one of the connecting branches, at least two different vessels each containing a different powdered material (P, Q) and each connected to a respective one of the at least two supply lines, and a vacuum line connected to the container for circulating the powder materials to the container for the at least two different vessels.

2. The device as claimed in claim 1, wherein the connecting branches open in the same direction into the container interior.

3. The device as claimed in claim 2, wherein the connecting branches are arranged at both ends of a common diametric (D).

4. The device as claimed in claim 1, wherein the connecting branches open in opposite directions into the container interior.

5. The device as claimed in claim 1, wherein the connecting branches are approximately parallel to each other, are provided on the container, and are assigned to a common radial plane (E).

6. The device as claimed in claim 5, wherein the connecting branches enclose an angle of inclination (w) with the common radial plane (E) toward a container axis (A).

7. The device as claimed in claim 6, wherein the angle of inclination (w) is between 10° to 45°.

8. The device as claimed in claim 6, wherein the connecting branches are inclined downwardly toward an interior of the container.

9. The device as claimed in claim 1, wherein the connecting branches are offset in height with respect to each other.

10. The device as claimed in claim 1, wherein a vessel interior of the collecting vessel is connected in a topward direction to at least one bottom aperture of the container.

11. The device as claimed in claim 1, wherein a branch line is connected to each of the at least two supply lines.

12. The device as claimed in claim 11, wherein the branch line is connected at another end to one of the vessels.

* * * * *